US012311253B2

(12) United States Patent
Lee

(10) Patent No.: US 12,311,253 B2
(45) Date of Patent: May 27, 2025

(54) BILLIARD LIGHT

(71) Applicant: Perceptive Lighting, Inc, Bayside, NY (US)

(72) Inventor: Ira Lee, Jericho, NY (US)

(73) Assignee: Perceptive Lighting, Inc., Bayside, NY (US)

( * ) Notice: Subject to any disclaimer, the term of this patent is extended or adjusted under 35 U.S.C. 154(b) by 180 days.

(21) Appl. No.: 17/900,794

(22) Filed: Aug. 31, 2022

(65) Prior Publication Data

US 2024/0066385 A1 Feb. 29, 2024

(51) Int. Cl.
*A63D 15/00* (2006.01)
*A63D 15/04* (2006.01)

(52) U.S. Cl.
CPC ..... *A63D 15/006* (2013.01); *A63D 15/04* (2013.01); *A47B 2220/0075* (2013.01); *A63B 2225/74* (2020.08); *A63D 15/00* (2013.01); *A63F 2300/80* (2013.01)

(58) Field of Classification Search
CPC ..... A63D 15/006; A63D 15/04; A47B 13/02
USPC ..... 473/1, 2
See application file for complete search history.

(56) References Cited

U.S. PATENT DOCUMENTS 5,791,758 A * 8/1998 Horgan ..... G02B 6/001 362/253
6,371,860 B1 * 4/2002 Anderson ..... A63D 15/006 473/31
6,609,307 B1 8/2003 Haynes et al.
7,611,417 B2 * 11/2009 Murrey ..... A63D 15/00 473/4
9,827,483 B2 * 11/2017 Bacus ..... H04N 9/8211
2004/0070149 A1 * 4/2004 Lipscomb ..... A47B 25/00 273/309
2024/0066385 A1 * 2/2024 Lee ..... A47B 13/02 473/1

FOREIGN PATENT DOCUMENTS

WO 90/02590 A1 3/1990
WO 2016/019288 A1 2/2016

OTHER PUBLICATIONS

International Search Report in PCT/US22/42269 dated Dec. 6, 2022.
Written Opinion of the International Searching Authority in PCT/US22/42269 dated Dec. 6, 2022.
Notification of Transmittal of International Preliminary Report on Patentability in PCT/US2022/042269 dated Jun. 12, 2024.

* cited by examiner

*Primary Examiner* — Mitra Aryanpour

(74) *Attorney, Agent, or Firm* — Collard & Roe, P.C.; William Collard

(57) ABSTRACT

A lighting system for a billiard table comprising a frame, a plurality of lights disposed in the frame, and at least one lens coupled to the frame. The at least one lens is configured to focus a light produced by at least one light disposed in the frame.

19 Claims, 18 Drawing Sheets

BILLIARD LIGHT

CROSS REFERENCE TO RELATED APPLICATIONS

This application is a non-provisional application which hereby claims priority to U.S. Provisional Application Ser. No. 63/239,357 filed on Aug. 31, 2021, the disclosure of which is hereby incorporated herein by reference in its entirety.

BACKGROUND OF THE INVENTION

Generally, when lighting a billiard table, the state of the art has been limited either to illuminate with a centrally hung chandelier of some type which typically casts a disproportionate concentrated illumination toward the middle of the playing surface or blankets the entire area above the table with an overly diffused light in an attempt to create an environment of even lighting across the playing surface. In practice, neither of these approaches is optimal for filming, playing or training on a billiard table.

The billiard table surface, unlike a conference room table, has two distinct depths. The table bed sits below the nose of the rail cushion by 35-37 mm. To improve playability and enhance the quality of any presentation of the game, the nose of the cushion is an important feature of the table that needs to be carefully and specifically lit in order to be clearly visible from a wide range of perspectives.

Employing mirrors and diffusers within light sources in billiard table lighting, scatters rays laterally which softens the shadows and floods light under the rail, which creates a situation where it is difficult to visually discern the "nose" of the cushion against the backdrop of the table bed, because both surfaces become lit equally brightly and both surfaces are covered by the same fabric. Lit with this approach, it becomes extremely difficult to discern the precise location of the rubber "nose" of the cushion against the backdrop of the table bed from a majority of overhead perspectives. When the depth of the cushion boundary is not rendered clearly on television, it is difficult for the fans to follow the action, and the production suffers greatly. In order to solve this problem, a completely opposite objective is required. Instead, there is a need for a lighting system which creates a hard shadow between the nose of the cushion, all around the table perimeter, to contrast its depth against the playing surface behind it. Using mirrors to redirect rays horizontally or employing diffusers designed to scatter the light, does exactly the opposite of what is necessary to achieve which is a hard light line providing a stark demarcation of the nose of the cushion.

SUMMARY OF THE INVENTION

One embodiment of the invention relates to an overhead lighting platform designed to facilitate precise illumination and provide for the aligned mounting of and control of precise LED and laser projections on and around a billiard playing arena. The target projection area is not limited to the top playing surface of the table, but also includes the sides of the table, rails, cushions, and the surrounding flooring in the playing space.

The platform described has precision alignment capability as well as the ability to fine-tune the position and alignment of all mounted components, including perimeter lighting sources and centrally directed light emitting devices (laser points/lines and/or LED projectors, as well as strategically placed sensors to capture light, sound, temperature and humidity. The mounting rig, called a "spine", uses an integrated laser line to perfectly align and calibrate its base position. Lasers and any other devices that require precision-aligned mounting to be easily centered over the table and fixed into place in a variety of useful and novel applications.

The downward focused light rays directed by the lenses create a hard shadow directly under it, that renders the nose of the cushion very clearly against the table bed. The lens helps to control the spread of light to create an even distribution that falls off relatively narrowly and certainly without flooding light under the rail cushion on the opposite side of the one being directly lit from above. Because of the fact that the adjacent light segments work together to concentrate the light more strongly into the corners. Depending on the height that the fixture is hung above the table, there is a necessity to block different amounts of light, in a controlled fashion, from regions along the various lengths of the perimeter so that, overall, while light rays remain focused to create the hard shadow needed directly below, their output is optimized to reduce hot spots. The exact pattern of the light blocking filter all around the perimeter of the fixture, depends on the spread of the lens being used and the height that the fixture to the table. If the focused lens concentrates too much light into a particular region, the filter is moderated to balance the undesirable contrast. Controlling the focus angle and intensity of the beams is the objective which is very different from a diffuser which spreads light around carelessly which would only serve to diminish the visibly reduce the definition of the subject cushion on the cushion across from the segment directly below the overhead lens. Lit in this way, the billiard table playability and production quality is improved. Thus, filters and lenses are used to sharpen the light instead of diffusers which soften the light.

When filming billiards for live television or streaming production, it is not only necessary to illuminate the playing surface of the table, but also important to control exactly how lighting is projected onto the entire stage—including where the athletes walk around and shoot from. The platform and rig allows for LED sources and devices to be mounted, not only inside the bounds of the frame, but also extended outwards (via telescoping extensions to the "spine" and "ribs") and outside of it as well. In addition, inward and outward-facing scoreboard displays are mountable to enable an immersive and interactive gaming experience for the users and fans.

The overhead platform described is flexible enough to handle a wide range of use cases where extremely precise positioning of overhead projections are needed. In a billiard application, exactly placed points, lines, and images using devices/sources including (laser diodes, lines, or LED projectors) are useful and desirable to have but extremely time-consuming and difficult to deploy, align and calibrate. For any billiard game, it is critical to mark the playing surface with specific key points and lines on the surfaces of the table to support a variety of games played as well as for training purposes. A host of applications on a billiard table would benefit by augmenting the table to support the attachment of precisely targeted overhead light sources. LED laser projectors (or 3D laser ray scan projection devices) can be used to project still or animated images of event logos, sponsors, gameplay indicators or scoring information, can also be projected onto the table surface and/or onto the floor area surrounding the table, pre or post-game, or presented during half-time or commercial break, for example—to be seen by fans and players.

For training purposes, carefully aligned projectors can be calibrated to focus light (images) directly on top of specific billiard table surfaces such as the rails, cushions to measure bank shots and kick shots for training and visualization purposes. Coupled with interactive software, extremely effective remote coaching can be facilitated. Projections can be static or dynamically generated and animated to support visualizations of ball positions and ball paths over time.

The projections help to make possible a number of interactive and digitally enhanced experiences on a billiard table. One application and implementation includes virtual gameplay with a remote player where the motions of the balls at one venue are recorded, forwarded, and projected remotely onto a table surface at their opponent's remote location—and visa versa—so that the two opponents can more directly visualize each other's plays and responses and thus simulate the experience of actually playing them in person by watching their opponents remote actions unfold in front of them as projections atop their local equipment. Another application includes remote (or local) instruction by a coaching where helpful and instructive lines are drawn onto a tablet device by a mentor, which is rendered directly onto a remote student's table to convey the correct guidance to be studied. Such direct guides would drastically augment the real experience of playing billiards while facilitating accelerated learning.

When playing billiards, there are always a number of important markings permanently installed on the table (generally, either adhered with a pressure sensitive sticker, inked-in with a pen, or written-in, less permanently, using a fabric pencil, for example.) Table markings are customary and often specific to certain games commonly played on a billiards table. For example, for all games currently played, the "foot spot" is a point on the "foot" side (racking side) of the table to indicate where one should rack the balls. The "head string" is the horizontal line that spans the width of the table which usually designates where the player should break from ("behind the line"). In 14.1 straight pool, the outer boundary of the rack outline is etched onto the table so that players can plan ahead to prepare the positioning of their last ball and continue their continuous runs.

In carom billiards, certain games require specific "balk lines" to be present on the table in order to regulate legal zones during plays in the game. A set of 5 to 9 spot markings are commonly used to designate where to position balls at the start of the game or during certain moments when balls need to be re-spotted.

Temporarily drawn markings and lines can be extremely useful training and practice tools. Usually, such markings never get drawn permanently on publicly used tables and are only seen on home-tables or in training centers.

The downside to physically drawing these markings are numerous: Once inked, they cannot be removed. Certain games require different markings and some markings are irrelevant or distracting when playing other games. —When obligated to place a ball directly onto a marking, one's vision is naturally obstructed by the ball, so precise positioning is extremely challenging. —Cloth often stretches and shifts over time and cause the position of the markings to shift and/or fade away.

Sticker markings often disrupt the path of the balls rolling over them. —It is not possible to easily configure. Lasers and projection patterns presented from directly above are useful to: —Precisely position a ball onto a designated spot. —Determine the winner of the lag. —Visualize lines and aiming points during practice—Organize training regimen and exercises—Can be reconfigured to adapt to whatever game or format is currently being played.

Players spend decades learning to understand exactly how to see and align themselves straight behind their shots before they can learn to shoot straight. It is a challenge and a struggle to understand the perspectives of each eye and position their bodies accordingly. Coupled together with the overhead mounted laser alignment line, a glass sphere, the size of a billiard ball, interacts with the laser beam overhead and provides an extremely clear and unique feedback to the player about precisely where their head is in relationship to the balls.

A glass (or acrylic) cue ball acts as a prism when interacting with the overhead light and refracts the light in a unique way to provide revealing alignment indications which are beneficial to help the practitioner understand the relationship of their head and eyes to the cue ball.

BRIEF DESCRIPTION OF THE DRAWINGS

Other objects and features of the present invention will become apparent from the following detailed description considered in connection with the accompanying drawings which disclose at least one embodiment of the present invention. It should be understood, however, that the drawings are designed for the purpose of illustration only and not as a definition of the limits of the invention.

In the drawings, wherein similar reference characters denote similar elements throughout the several views.

DETAILED DESCRIPTION

Figure 1A:
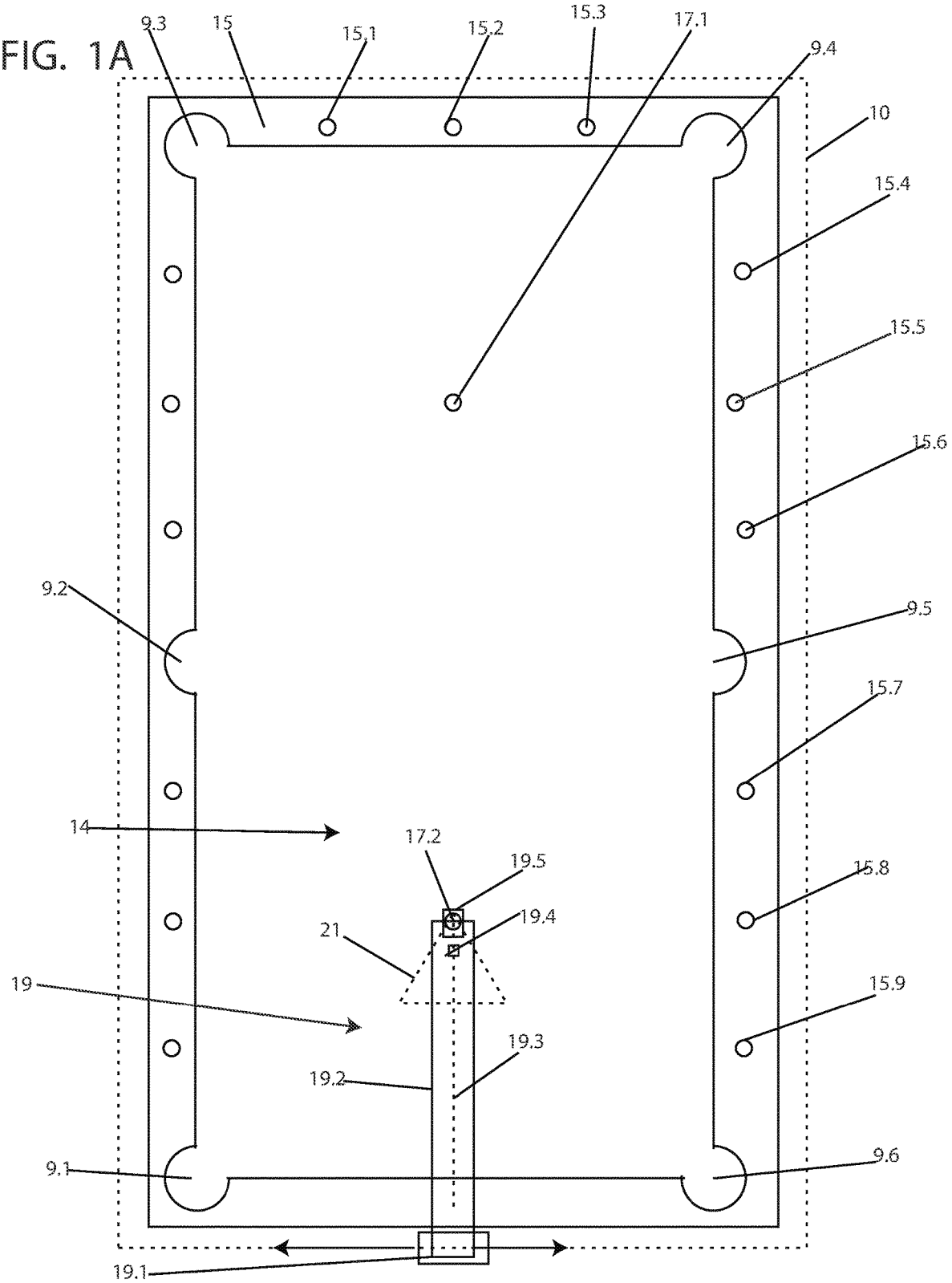
FIG. 1A is a plan view of a first embodiment.

Referring to the drawings, FIG. 1A is a plan view of the first embodiment which includes a light frame 10 which includes a center extending arm 19 having a coupling 19.1 which is axially slidable on rails of the frame 10. This arm 19 includes an extension section 19.2 which has inside a power and control feed 19.3. There is a first light 19.4 which is an optional light which extends up above towards the ceiling which indicates that the device is "on". In addition, there is a light 19.5 which is a laser light which shines down on ball maker 17.2 and which is used to either allow the placement of a triangle rack 21 or the marking of the cue ball on that spot.

The billiard table 14 includes a plurality of pockets 9.1, 9.2, 9.3, 9.4, 9.5, and 9.6. This table also includes another ball marker 17.1. There are also a plurality of side ball placement markers on the rails of the table 15 including markers 15.1, 15.2, 15.3, 15.4, 15.5, 15.6, 15.7, 15.8, 15.9.

Figure 1B:
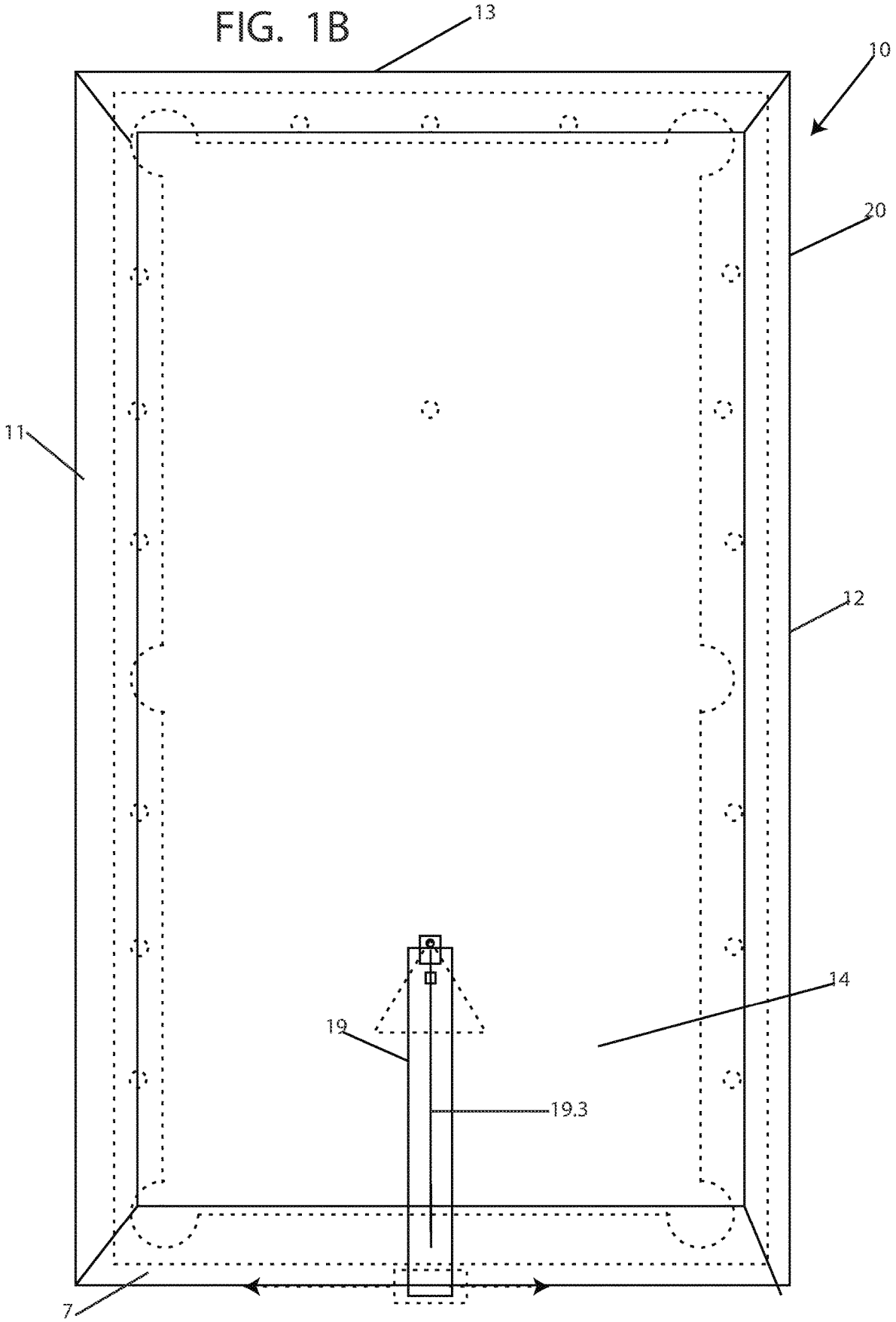
FIG. 1B is a plan view of the embodiment of FIG. 1A.
Figure 1C:
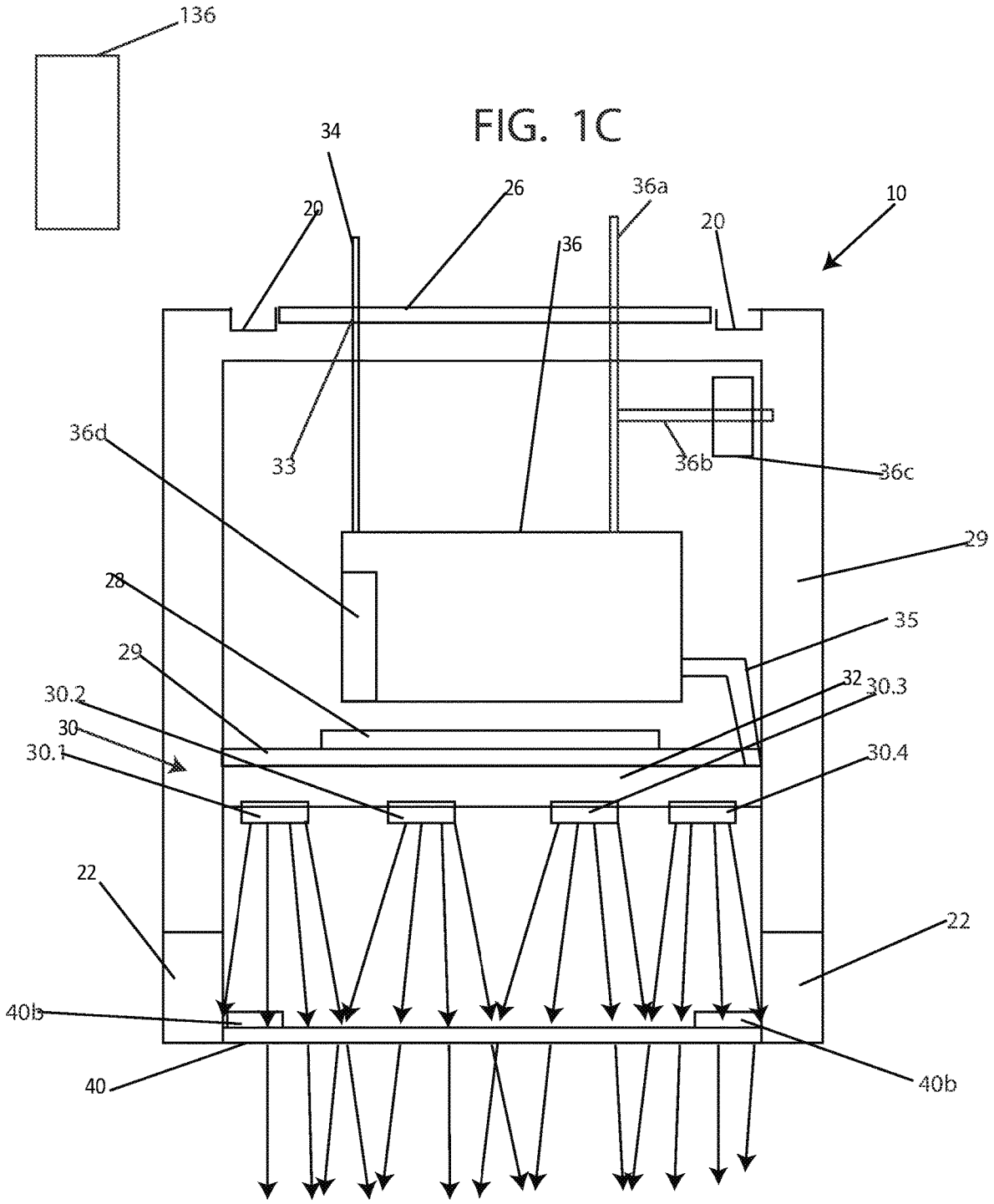
FIG. 1C is a side cross-sectional view of the light.

FIG. 1B shows a plan view of the frame 10 which includes the arm 19. In this case the pool table or billiard table 14 is shown in dashed dotted lines. The frame 10 includes sides 7, 11, 12 and 13. The arm 19 obtains power from the power lines inside of the frame 10 such as shown in FIG. 1C which shows the cross-sectional view of these sections. For example, power line 19.3 obtains power from power supply 36 housed in frame 10. It may be remotely switched via the power controller 36*c* housed within the frame.

FIG. 1C shows a cross-sectional view of a frame which houses at least one LED light. The light frame 10 comprises a frame 20 which comprises a lid 26 with a groove for sliding clamps. There is a lip groove 22 for holding the lens 40 and filter which includes a corner connection to a lens 40. There is also a segmented lid 26 to allow for containing various power drivers wiring and power distribution, computer controllers, and an exit hole 33 for RF antenna 34 to extend control of lighting (power, lumens, or color temperature) wirelessly in the remote range. A spacer bracket 29 comprising an aluminum heat sink 28 formed integral therein is positioned inside of the frame 20. The heat sink can optionally have grooves or fins for adding surface area for aiding in cooling. wherein the spacer bracket is configured to support the LED circuit board 32 for housing the LED's 30. The LEDs 30 are LED chips forming a light source. There is an AC/DC power supply driver 36 having an AC power cord 36*a* which is configured to be plugged into a power supply (AC power supply). At the opposite end of the driver are low voltage DC power cables 35 to feed into the circuit board 32.

One or more additional AC power cords 36*b* tap from the external power line to provide power to any of the mounted peripherals (e.g., lasers, projects, etc.). Each powered peripheral device can be remotely switched via a wireless control unit 36*c*. Full control of the LED lights as well as the laser and projectors onto the table surface can be coordinated and balanced wirelessly via remotely running control software.

The lens 40 is a downlight lens configured to focus the light provided by the LED's so that a focused beam is presented or produced from the frame 20. In certain sections, there are light blocking filters 40*b* which are configured to regulate the concentration of light on regions of the table, potentially applied to balance or compensate for external lighting conditions. For example, in this design, light blocking filters 40*b* are positioned on the periphery of the lens.

FIG. 1C also shows a transceiver 36*c* disposed along line 36*b* to control the output of line 36*b*. In addition there is also shown transceiver 36*d* disposed inside of power box 36 to control the power being fed to the LED's to control the brightness of the LED's. In addition, there is also a controller 136 such as a smartphone which is configured to send instructions to these transceivers 36*c* and 36*d*. These instructions can be in the form of wireless instructions such as via WIFI, cellular, Bluetooth or any other suitable form of communication.

Figure 2:
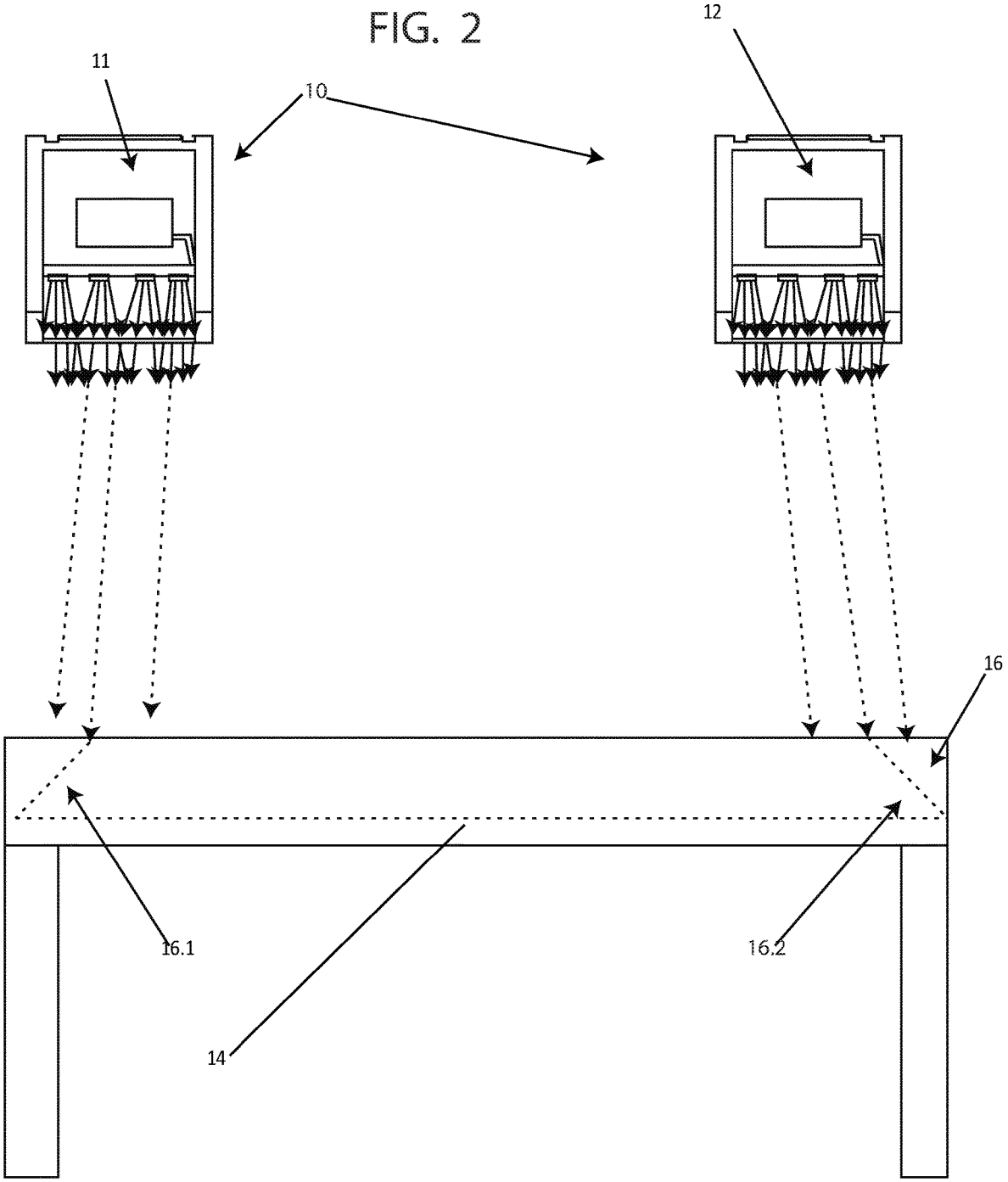
FIG. 2 is a side view of the light positioned over a table.

FIG. 2 is a side view of the light positioned over a table. In this view there is shown a cross-sectional view of frames 11 and 12 which produce the light for a table such as a billiard table. These frames 11 and 12 are positioned above the nose/bumpers of the table. The billiard table 14 comprises bumpers 16. These bumpers 16 are wooden rails with a rubber cushion facing the inside of the table. Because a focused light is produced on these bumpers it creates a shadow from these bumpers thereby showing the presence of these bumpers more prominently because of the hard shadows that are produced by the lens 40. In previous different designs, a frame would be coupled to a diffuser and not a lens. When a diffuser is used instead of a lens, the diffuser "diffuses" or softens and spreads the light rather than focusing the light thereby causing a softening of the contours of the bumpers which makes the bumpers less visible. Therefore, in order to accentuate the presence of the bumpers, a lens is used instead of a diffuser. This allows for the creation of shadow areas 16.1 and 16.2 underneath bumpers 16. In addition, blocking filters such as blocking filters 40*a* and 40*b* are also used.

Figure 3:
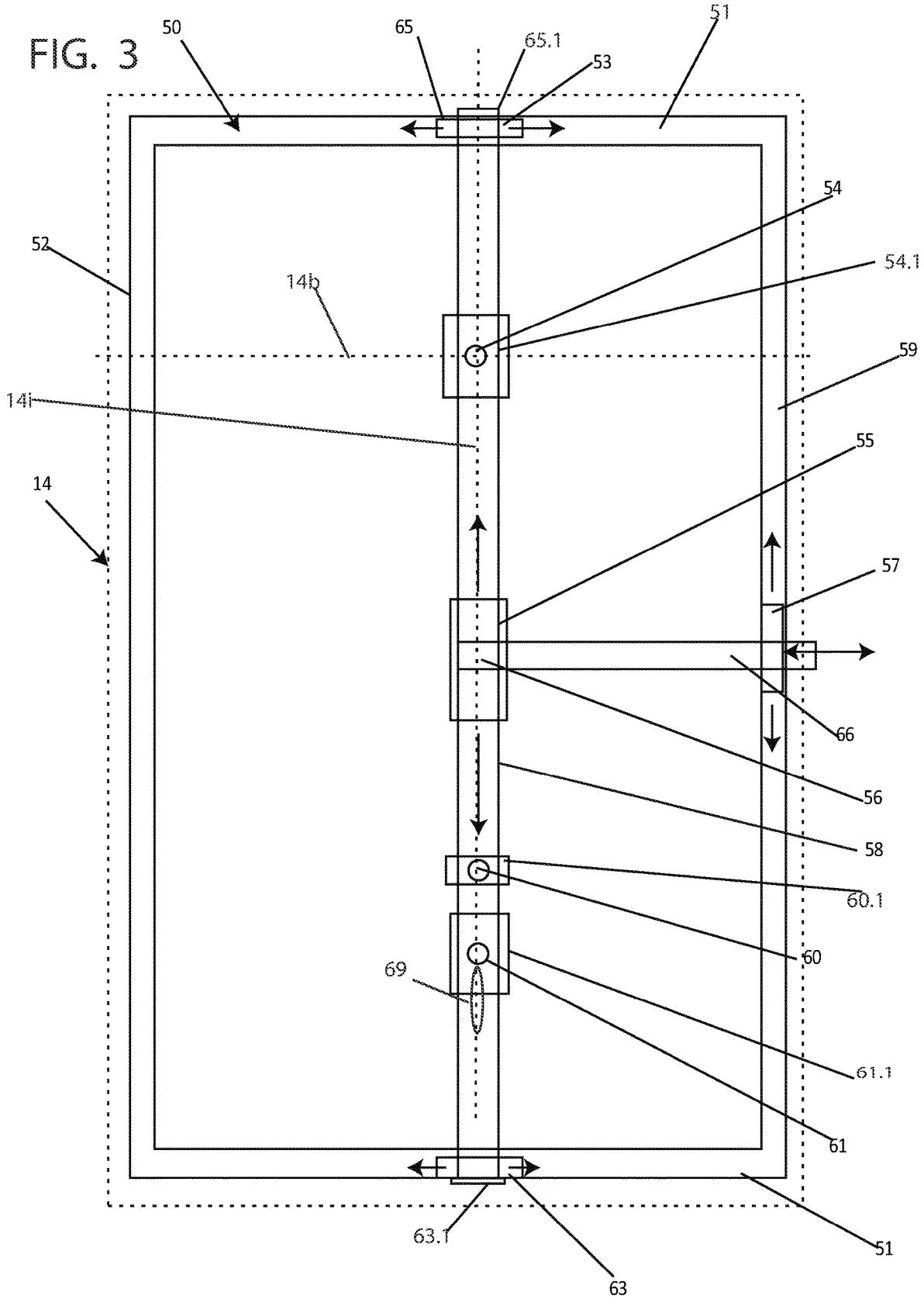
FIG. 3 is a plan view of another embodiment of the light.

FIG. 3 is a plan view of another embodiment of the light which includes a rectangular frame 50. The rectangular frame 50 is a light base platform having longitudinal extension 52 and latitudinal extension 51 for forming a substantially rectangular light. The frame has a lid 59 which is segmented for access to power distribution lines and RF antenna wires. There is a center beam 58 which is coupled at each end via clamps 53 and 63 to the latitudinal (shorter) extensions 51. Coupled to this center beam 58 is a laser line projector 54 and a laser 60. Laser 60 is coupled to coupler 60.1.

This laser line projector 54 housed in a coupling 54.1 and is adjustable fore/and aft can sway have a fan angle. In at least one embodiment this laser line 14*b* extends latitudinally. The laser line which is sent from the laser line projector 69 is for an extended line 14*i* extending across the length of the table and which is used for alignment of the light. The laser dot coupler 60.1 is for setting a laser light 60 for the rack point of the triangle. In essence these laser light sources are positioned over a center region of the table and are used for dispersing light to the table so that the outer frame 50 can be positioned above the table to create a substantially even distribution of light while still providing for substantial shadowing of the bumpers on the billiard or pool table. There are slidable mounts such as mount 65 or 63 which can be slidable along the latitudinal expanse 51 of the frame 50. There is also a rib 66 which is coupled to the outer frame 50 via sliding bracket or mount 57 as well. The frame 50 is formed from the individual frames 7, 11, 12, and 13 shown in FIG. 1B. with each of the latitudinal expanse 51 and the longitudinal expanse 52 formed from these frames 20 (See FIG. 1C) to create a substantially rectangular light frame housing LED lights which are configured to shine down on a table.

This frame can be embedded into a ceiling such as a drop ceiling or hung from a ceiling as well. Rib 66 is coupled to center beam 58 via locking couplers 55 and 56, with rib also being slidable on the longitudinal expanse 52 via sliding mount 57. The locking couplers comprise a tubular spine coupling section (telescopic) with locking mechanism 56. The center beam forms 58 forms a spine section with power/control which has wire holes for wire management. All of these wires are hidden inside the tubular spine for a clean and neat look. There is also a tubular spine segment protrusion 63.1 for coupling/locking extension arms at foot of the table. In addition, there are tubular spine segment protrusion for coupling/locking extension arms at head of table 65 as well. Tubular rib segment 66 shows a protrusion for coupling/locking extension arms outside of table. In addition, there is a laser line projector 69 coupled to coupling 61.1 and which is for projecting a laser line 14*i*.

Figure 4A:
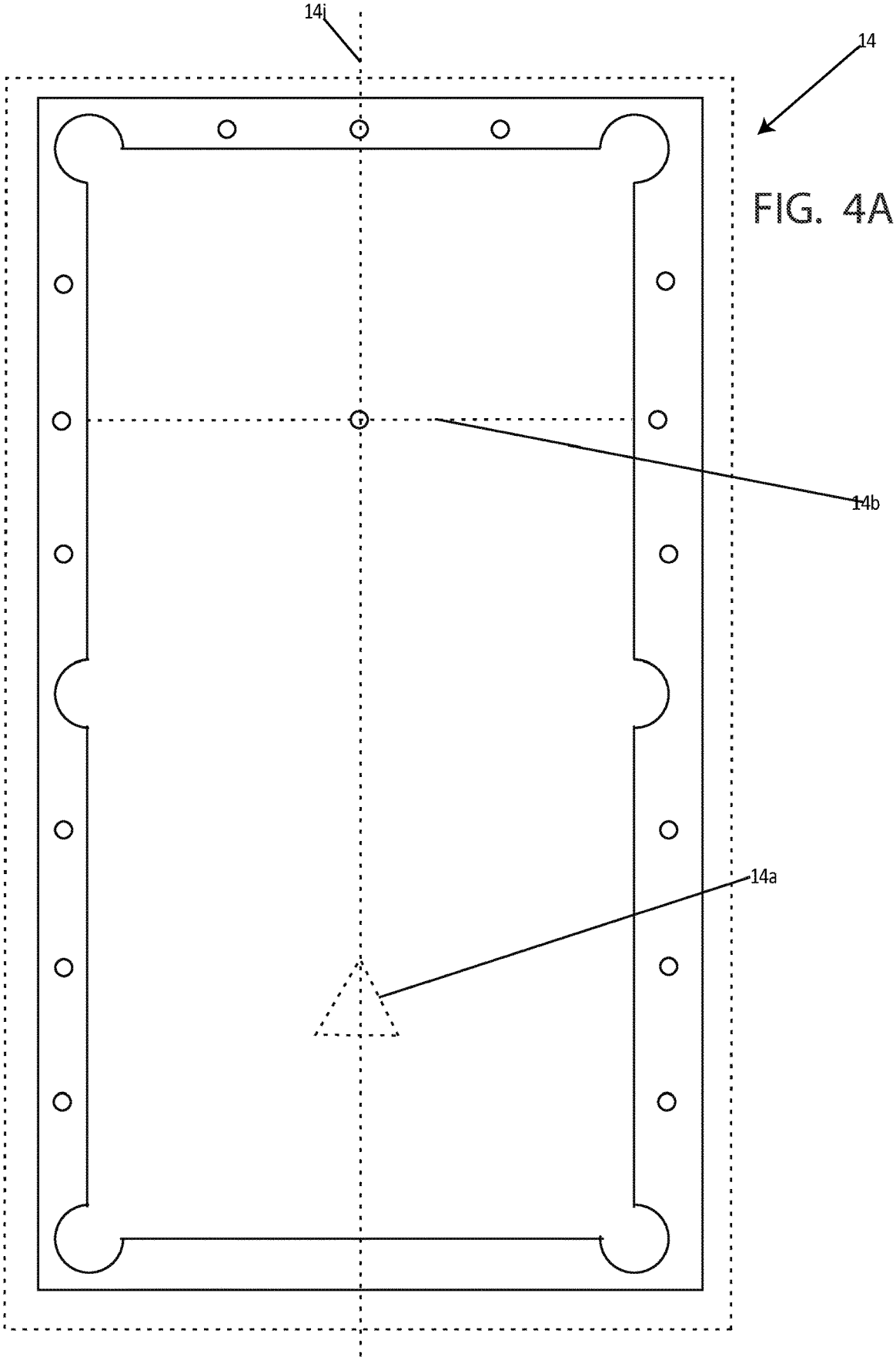
FIG. 4A is a top view of a table.

FIG. 4A is a top view of a pocket billiards table showing the lighting effects that can be created on the table with the laser line projected by the laser line projector 54 (See FIG. 3) on the table. For example, line 14*i* is a laser projection line created by laser projector 69 positioned below laser 61. This laser line 14*i* is projecting onto the floor and ending on the table from laser line creator 54. This line is used for footwork training. In addition, triangle 14*a* is used as a three-segment set of lines using three-line drawing lasers (See laser 61 which is three separate line lasers forming a triangle 14*a*) with cut off filters to control the length of the line laser. Line 14*b* can be created by laser 54 is a laser line projection to form the head-string which is the line where the player is required to place the cue ball behind. This line is produced by an overhead laser line producer 61 using beam limiters or filters to cut off the beam at the edge of the bumpers.

Figure 4B:
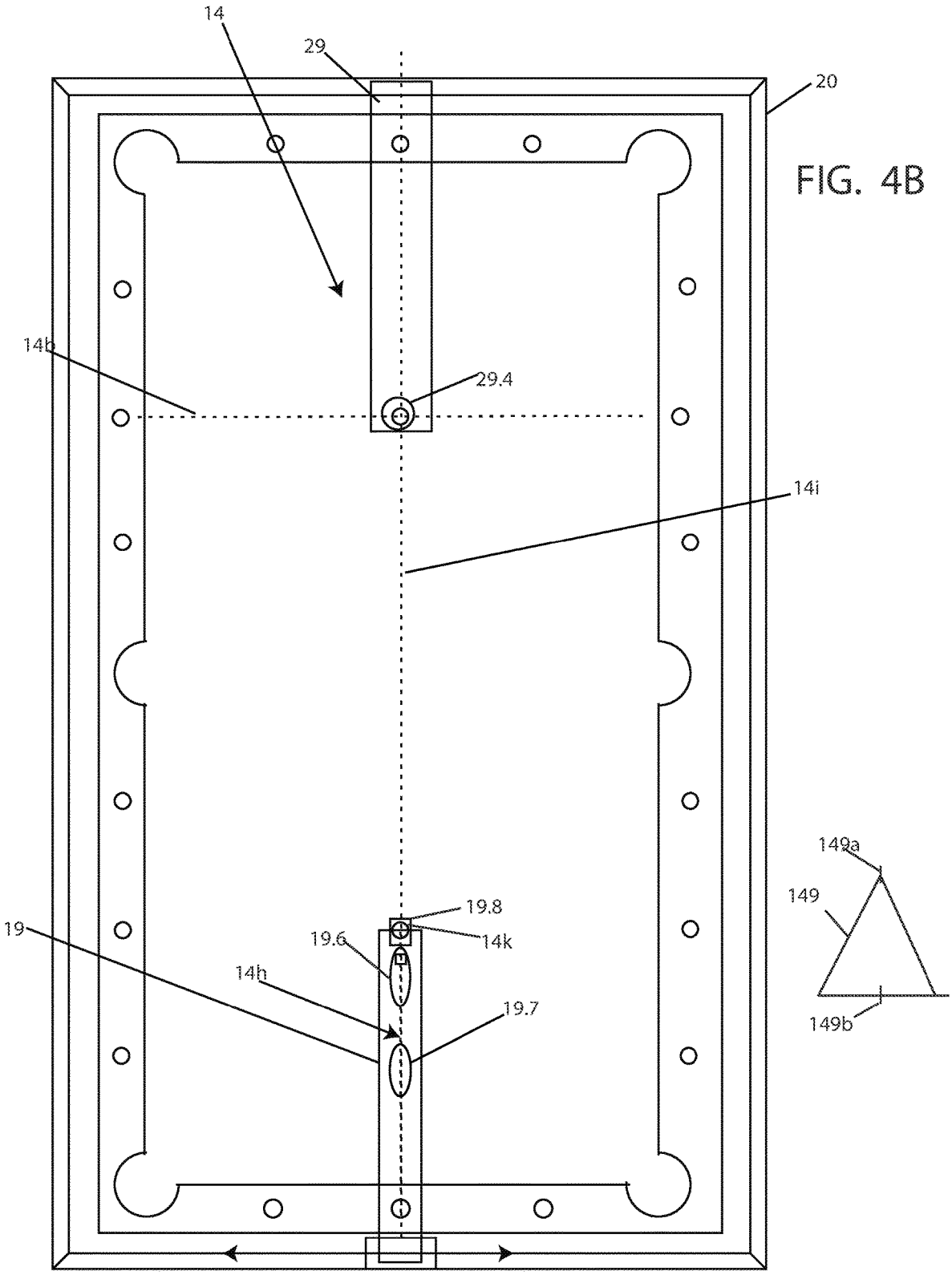
FIG. 4B is another top view of a table.

FIG. 4B is another top view of a pocket billiards table having extending arms 19 and 29 extending from frame 20 (See FIG. 1B showing frame 20). These arms 19 and 29 are coupled to the frame 20. Arm 29 is used to mount laser line producer 29.4 which is used to mark the head-string 14*b*, or zone from where the opening break shot is taken. Arm 19 is used to mount laser line producer 19.6 and project a useful line for aligning the racking device 14.1 on the opening shot as well as re-spot balls during play. A laser line producer 19.7 is also positioned on arm 19 to create laser line 14*i*. Essentially these line components are defined as follows:

14*b*: Head-string laser projection produced by a single laser line producer 29.4.

14*h*: Rack alignment laser projection produced by a single laser line producer 19.6 spanning from the center marker of the end-rail to the foot-spot. This line acts as a guide to coincide with the centered markings 149*a* and 149*b* of a specially marked ball racking device 149 (e.g., triangle frame or template) to ensure that the arrangement of the racked balls at the start of each game is symmetrical to the table.

14*i*: center line extending lengthwise along the center of the table created by the line laser 29.3

There is also a laser 19.8 coupled to arm 19, which creates a spot or marking (temporary) 14*k* to mark the location of the placement of the cue ball on this end of the table. Each of these arms is fed with an electrical input from frame 20 and is configured to be controlled by the controller 136 communicating with transceivers 36*d* and 36*c*.

Figure 4C:
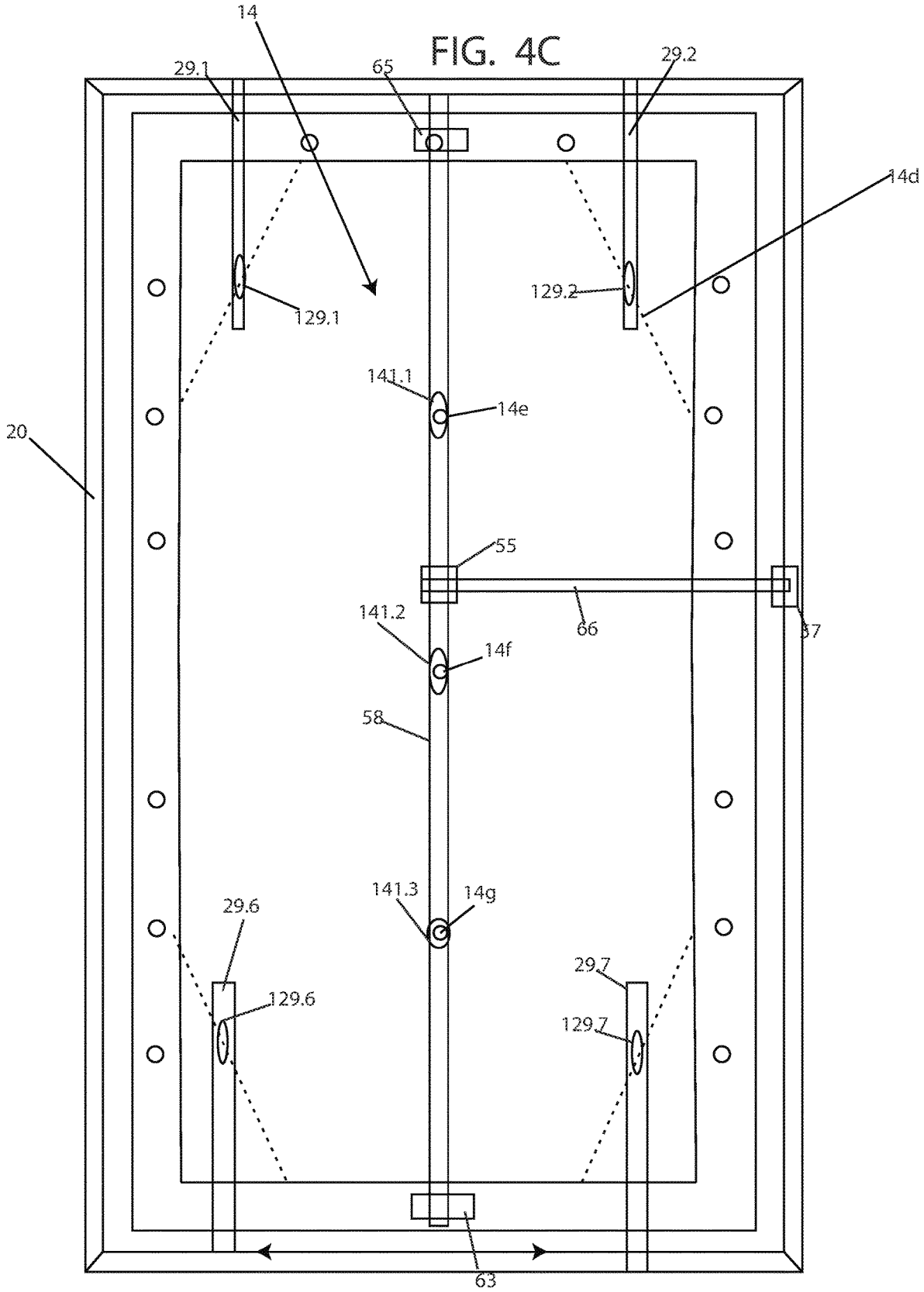
FIG. 4C is another view of a table.

FIG. 4C is top view of a pocketless carom billiard table having a "spine" beam 58 extending arm 58 wherein the laser lines can show balk lines 14*d* for special games. In this view there are multiple extending arms 29.1, 29.2, 29.6, 29.7. These arms each have laser line projectors 129.1, 129.2, 129.6, and 129.7 respectively, for producing balk lines 14*d* to mark playing zones within each corner of the carom billiards table.

On extending arm 58 the laser dot producer 141.1 can be used to show one or more spots such as the head spot(s) 14*e*, (produced by a single laser dot) the center spot 14*f*, as well as the foot spot 14*g*. Other useful ball-marking spots 141 may be projected onto fixed positions on the table by mounting laser beam dot producers onto any number of tubular ribs 66 that are coupled to the spine and frame.

Essentially these components are defined as follows:

14*d*: Balkline line projection produced by laser line producer 129.1, 129.2, 129.6, and 129.7 directly mounted overhead (on arms with beam limiters).

14*e*: Head spot laser projection produced by single laser beam dot 141.1 mounted onto the spine directly over the head-spot.

14*f*: Center spot laser projection produced by single laser beam dot 141.2 mounted onto the spine directly over the center-spot.

14*g*: Foot spot laser projection produced by single laser beam dot 141.3 mounted onto the spine directly over the foot-spot.

Figure 5:
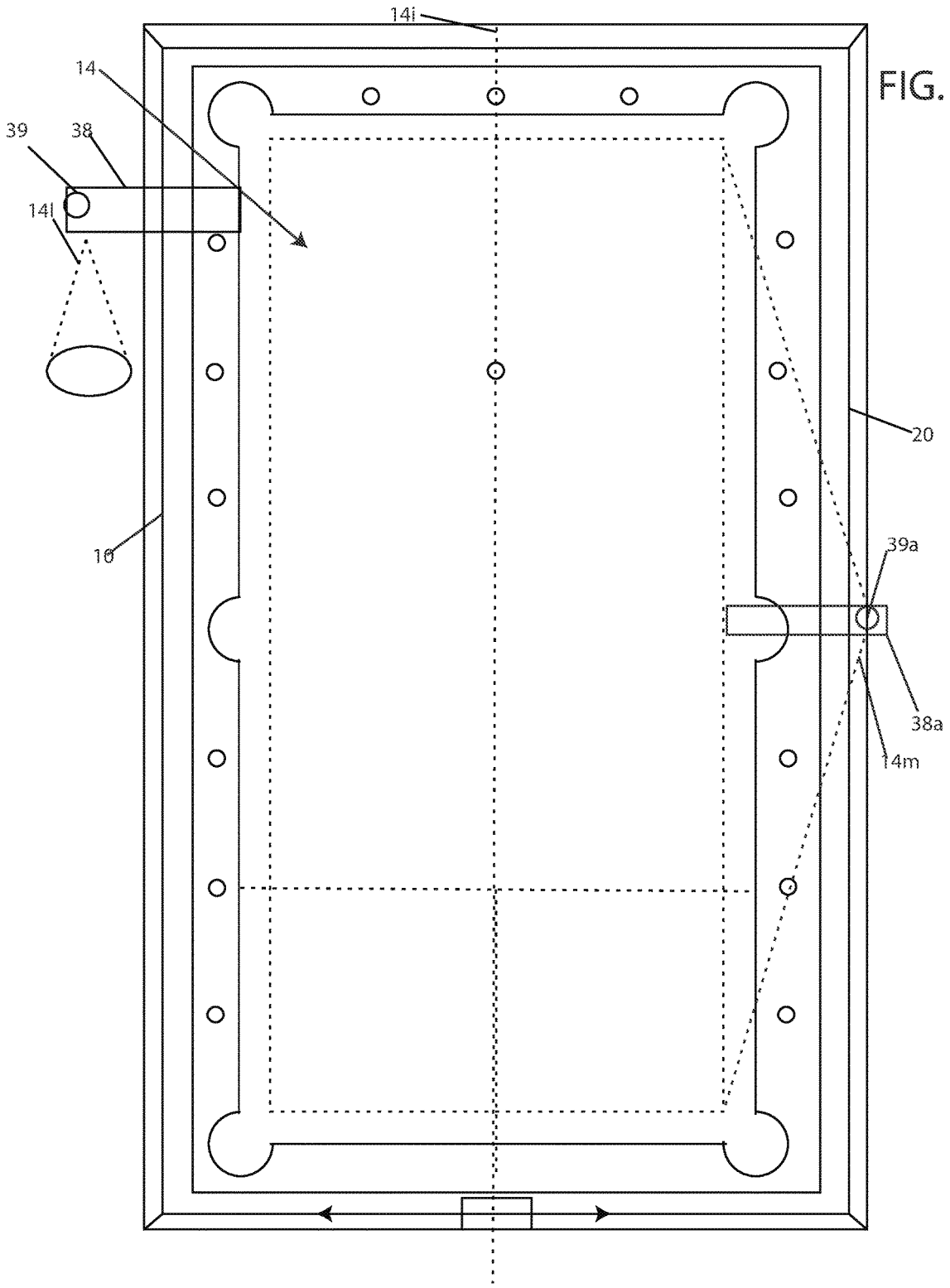
FIG. 5 is another top view of a table.

FIG. 5 is a top view of a table 14 showing projection images or artwork 14L on the floor outside of the boundaries of the table as well as generated images or artwork projected within the boundaries of the table. The projection device 39*a* is coupled to arm 38*a*. Arm 38*a* is coupled to a frame such as frame 20. This view shows extending arm 38 and 38*a* extending out from frame. Arm 38 has a projector 39 which shines a logo down on a floor area adjacent to the billiard table 14. Arm 38*a* has a projector 39*a* which projects generated images or artwork 14M directly onto the billiard playing surface.

Figure 6:
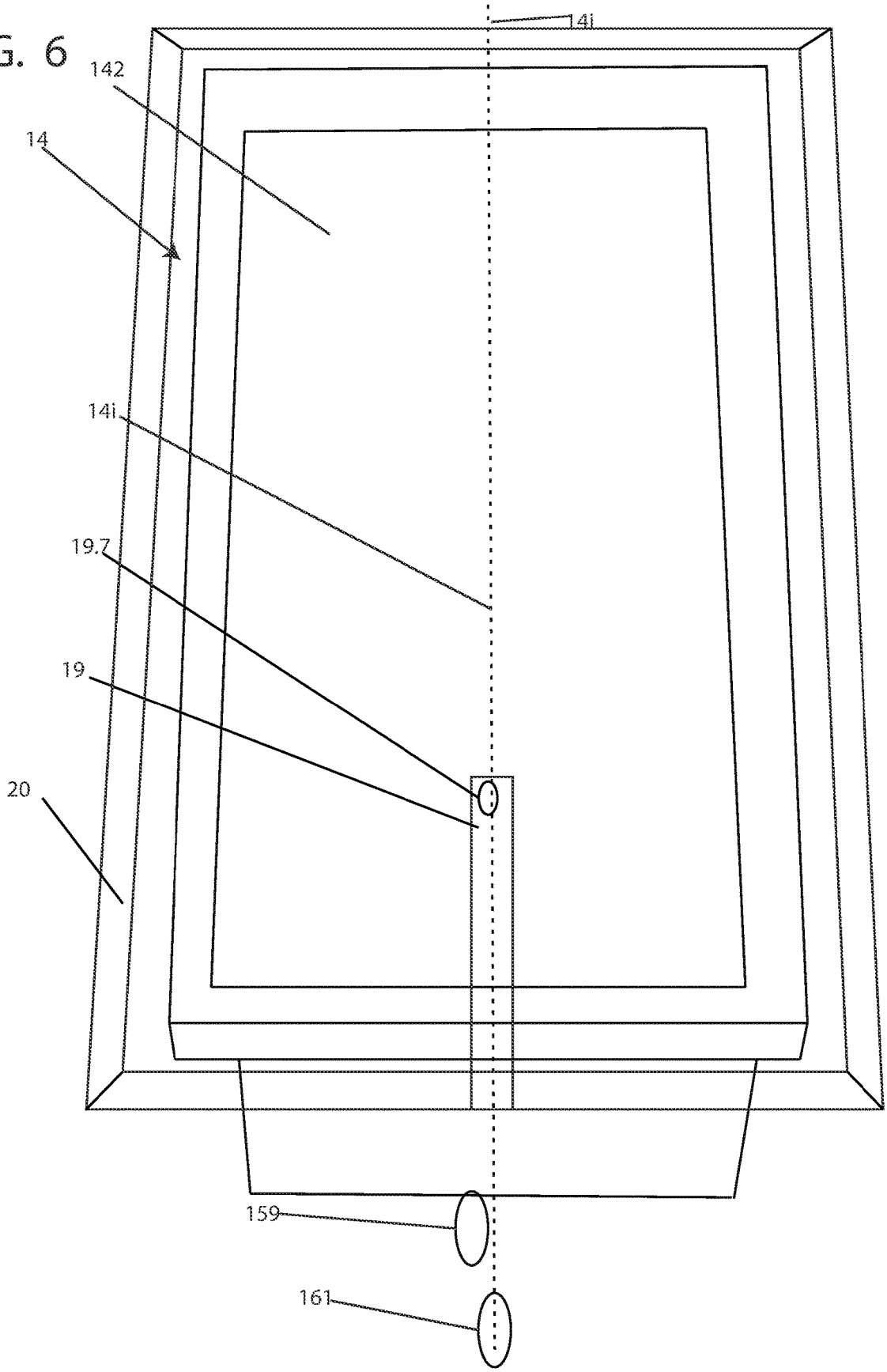
FIG. 6 is a side perspective view of a table with a laser light shining on it.

FIG. 6 is another top view of a table 14 which shows a frame 20 which has an arm 19 coupled thereto. There is a laser line creator 19.7 which creates a laser line 14*i* along the longitudinal axis of the table. There is a table surface shown 142 as well. Line 14*i* can be used for foot placement when a user is practicing their shots. There are thus shown two feet placements 159 and 161 shown wherein foot placement 161 is shown along line 14*i*.

Figure 7:
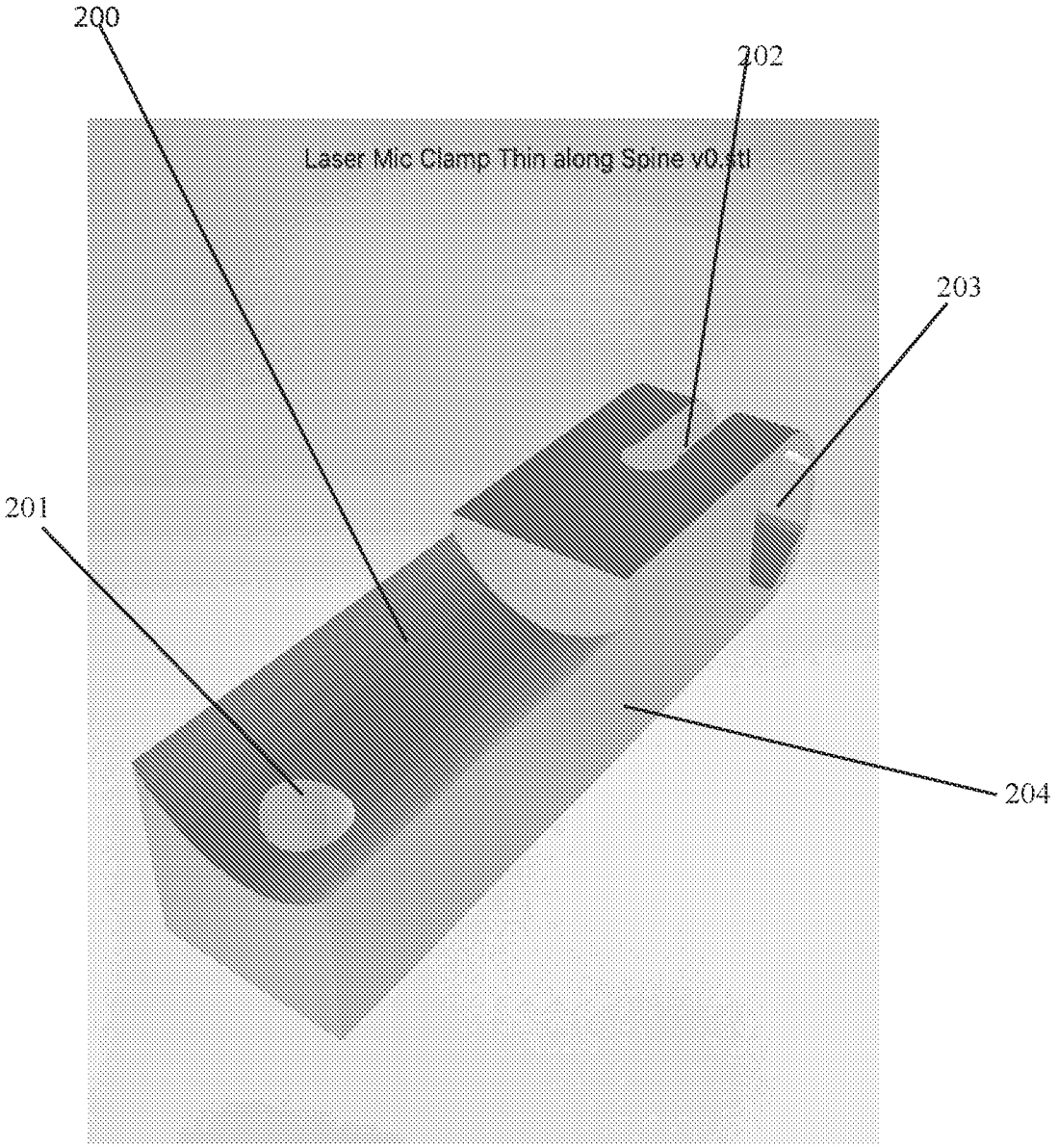
FIG. 7 is a perspective view of a laser mic clamp for holding a laser light.

FIG. 7 is a perspective view of a laser clamp for holding a laser light such as laser lights 54, 60 and 61, This clamp 200 includes a body section 204 which is substantially concave and has a hole 201 for having a locking pin secure to a laser shaft which is housed inside of the body of the clamp 200. The head section of this clamp includes two openings 202 and 203 which allow this laser clamp to be adjusted laterally as well as rotationally.

Figure 8:
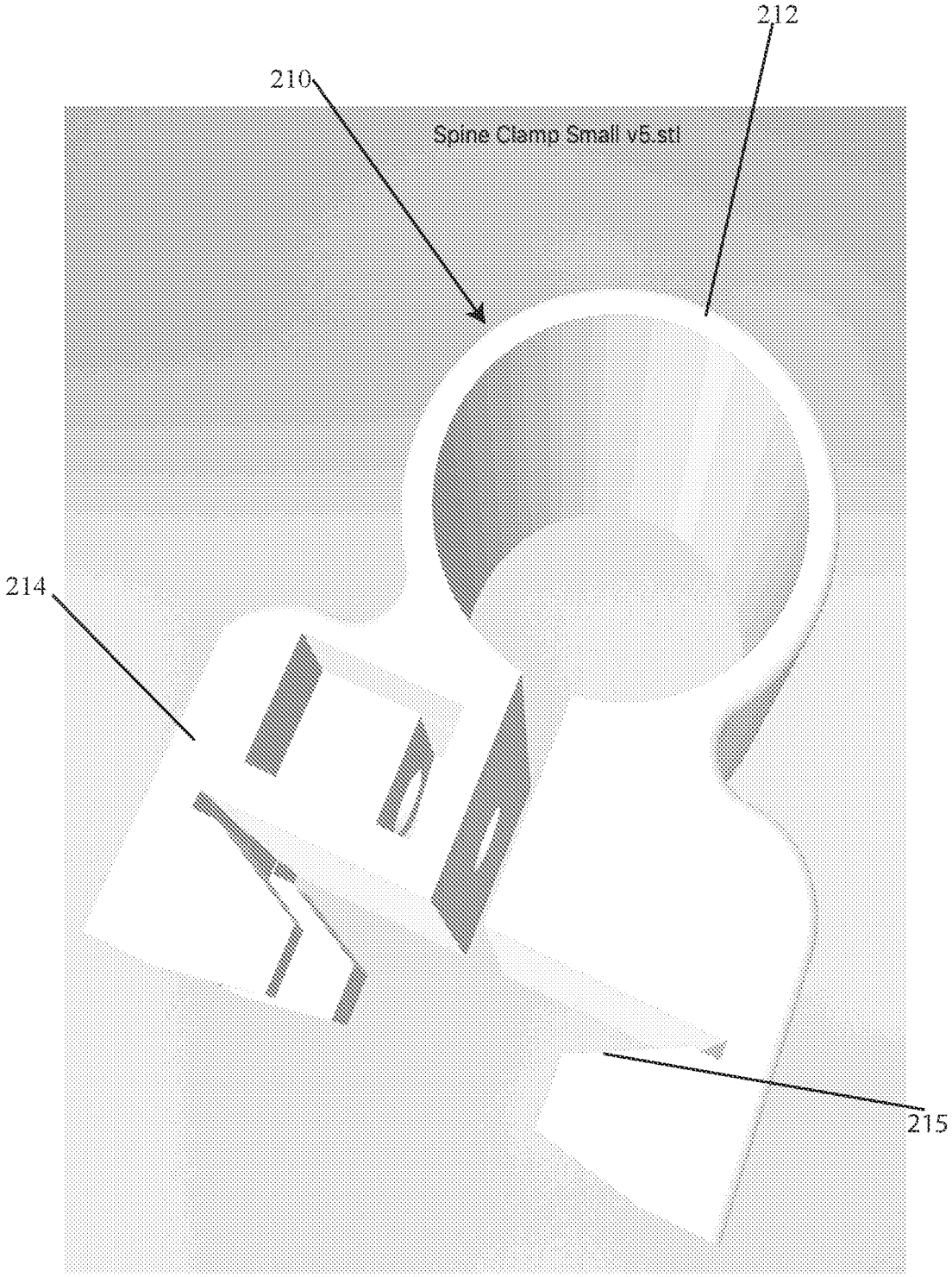
FIG. 8 is a perspective view of a spine clamp.

FIG. 8 is a spine clamp for clamping both the beam 58 and the rib 66. FIG. 8 is a perspective view of a spine clamp 210 which can be used to. This spine clamp is essentially similar to the clamps or mount 53, 57, and 63 which clamp the beam 58 and rib 66 to the remainder of the frame 50. This clamp 210 includes a body section 214, a tubular or cylindrical head section 212 as well as a slot 215. Slot 215 allows this clamp to be slid axially along the frame 50 or frame 20 to allow for lateral or longitudinal adjustment along a track disposed on the back side of the frame 50 opposite the side which contains the lens 40. The following are definitions of the components shown in FIG. 8: 210: Spine-mount clamp device;

212: Flexible sleeve to tighten around tubular spine segments; 214: Embedded tightening bolt to tighten clamp onto spine tightly, 215: Frame-bracket clasp to lock spine-mount down onto frame (using spine-mount foot-spacer lock)

Figure 9:
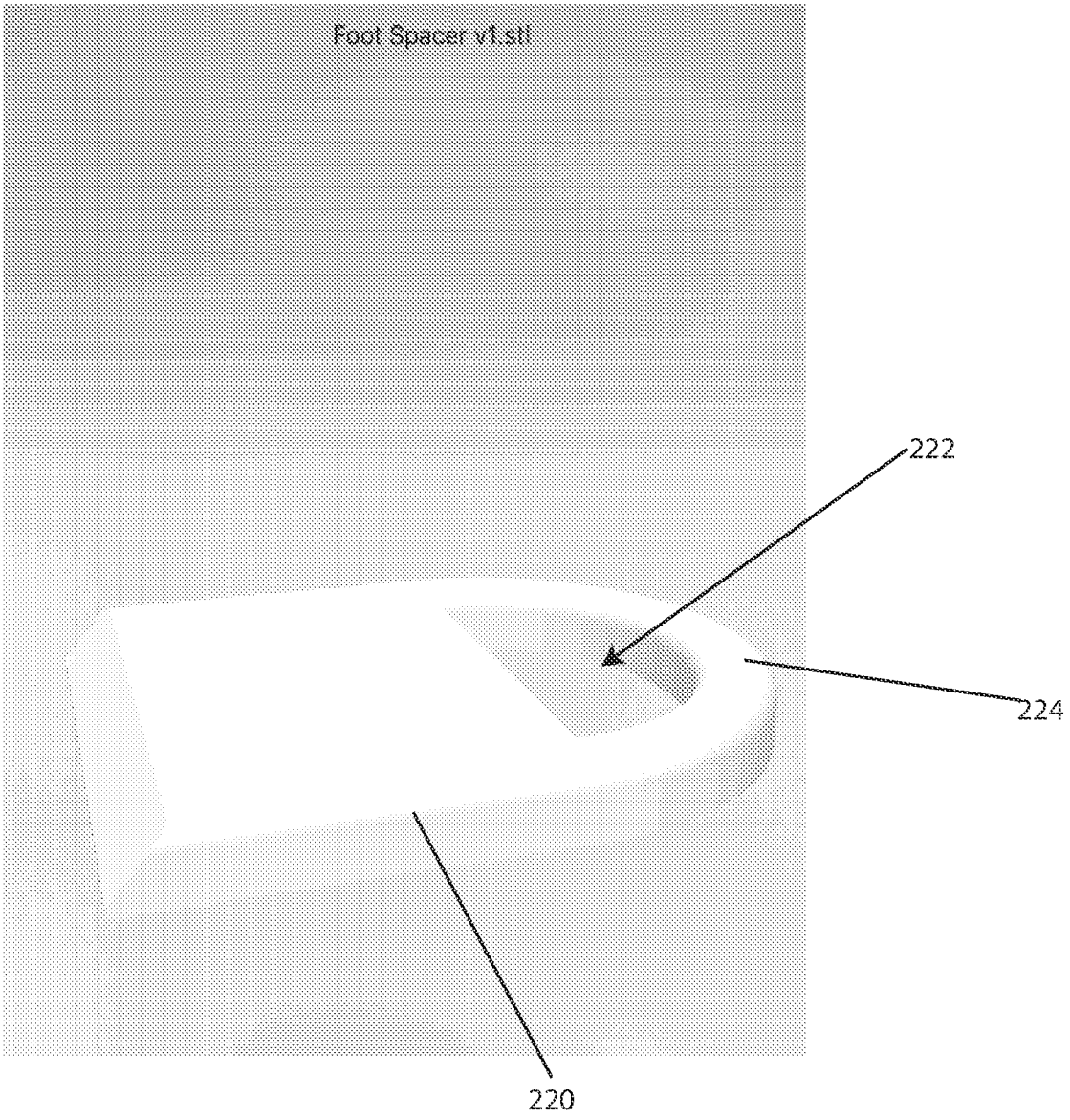
FIG. 9 is a perspective view of a foot spacer.

FIG. 9 is a perspective view of a foot spacer 220 having a bridge section 224 and an open section 222. Foot-spacer 220 slides under the spine-mount clamp between clamp and frame to lock spine-mount into place. Handle-space 222 allows the user to put their fingers around a pull 224. Pull 224 is configured to pull foot-spacer away from spine-mount to release locking action: The handle is configured to push foot-spacer tightly under spine-mount to lock mount into place on frame. The following are the definitions of the components shown in FIG. 9: 220: There is a foot-spacer 222 which slides under Spine-mount clamp between clamp and frame to lock spine-mount into place: Handle-space to pull foot-spacer away from spine-mount to release locking action. 224: Handle to push foot-spacer tightly under spine-mount to lock mount into place on frame.

Figure 10:
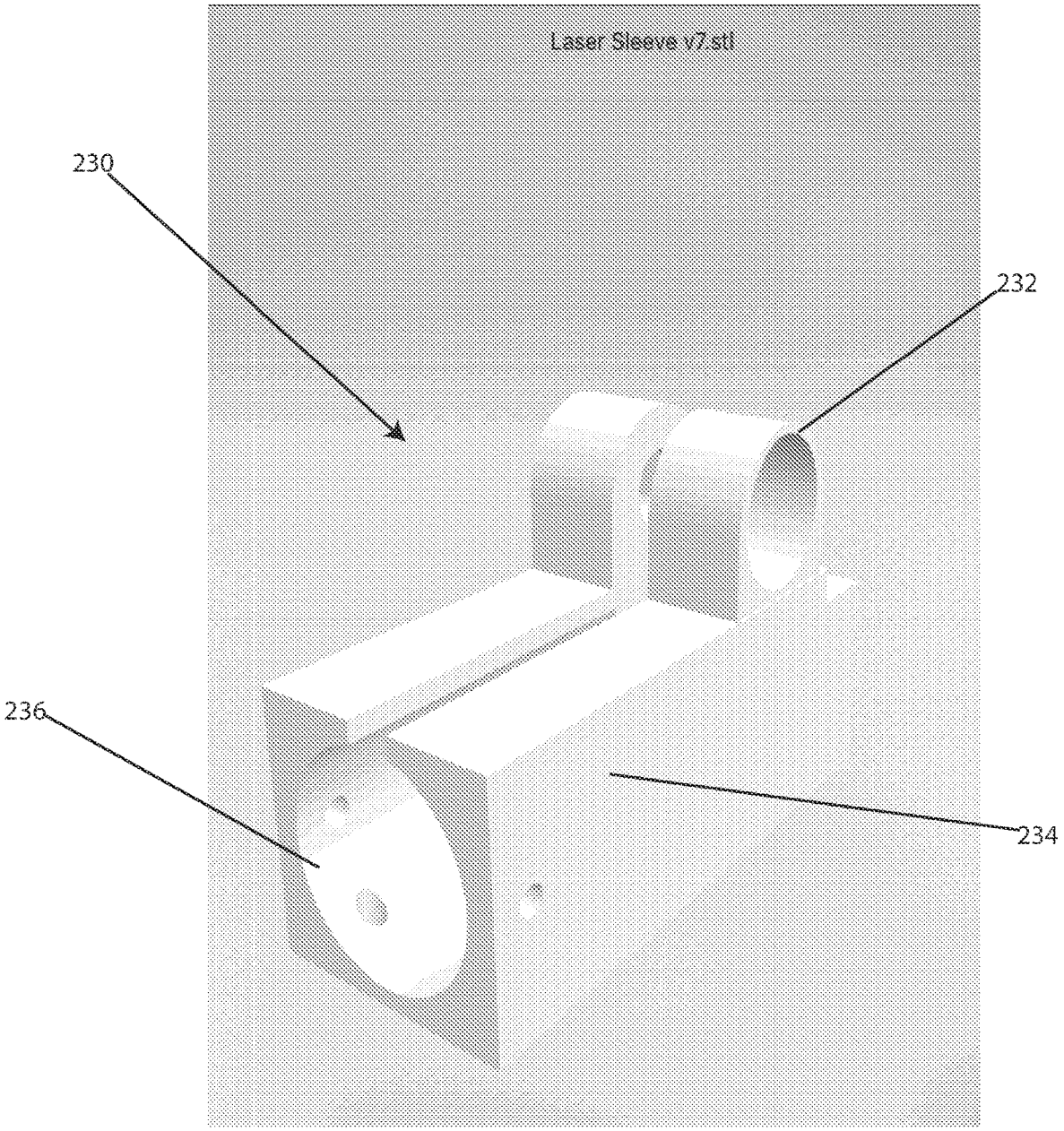
FIG. 10 is a perspective view of a laser sleeve.

FIG. 10 is a perspective view of a laser sleeve 230 which includes a block section 234 a hollow section 236 and a loop section 232. The block section 234 having the hollow section 236 is configured to house a cylindrical shaped laser beam device such as laser beam devices 54, 60 and 61 using sleeves 54.1, 60.1 and 61.1. Loop section 232 is configured to receive a lock which clamps and locks the block section 234 to a laser. The following are a list of components which are shown in FIG. 10: 230: Adjustable angle laser-line device holster to attach to spine; 232: Tightening screw/nut to clamp onto laser device; 234: Side of laser holster with 3 hole(s) for fine-tuning screws used to calibrate direction of laser 236: Inner chamber of laser holster.

Figure 11:
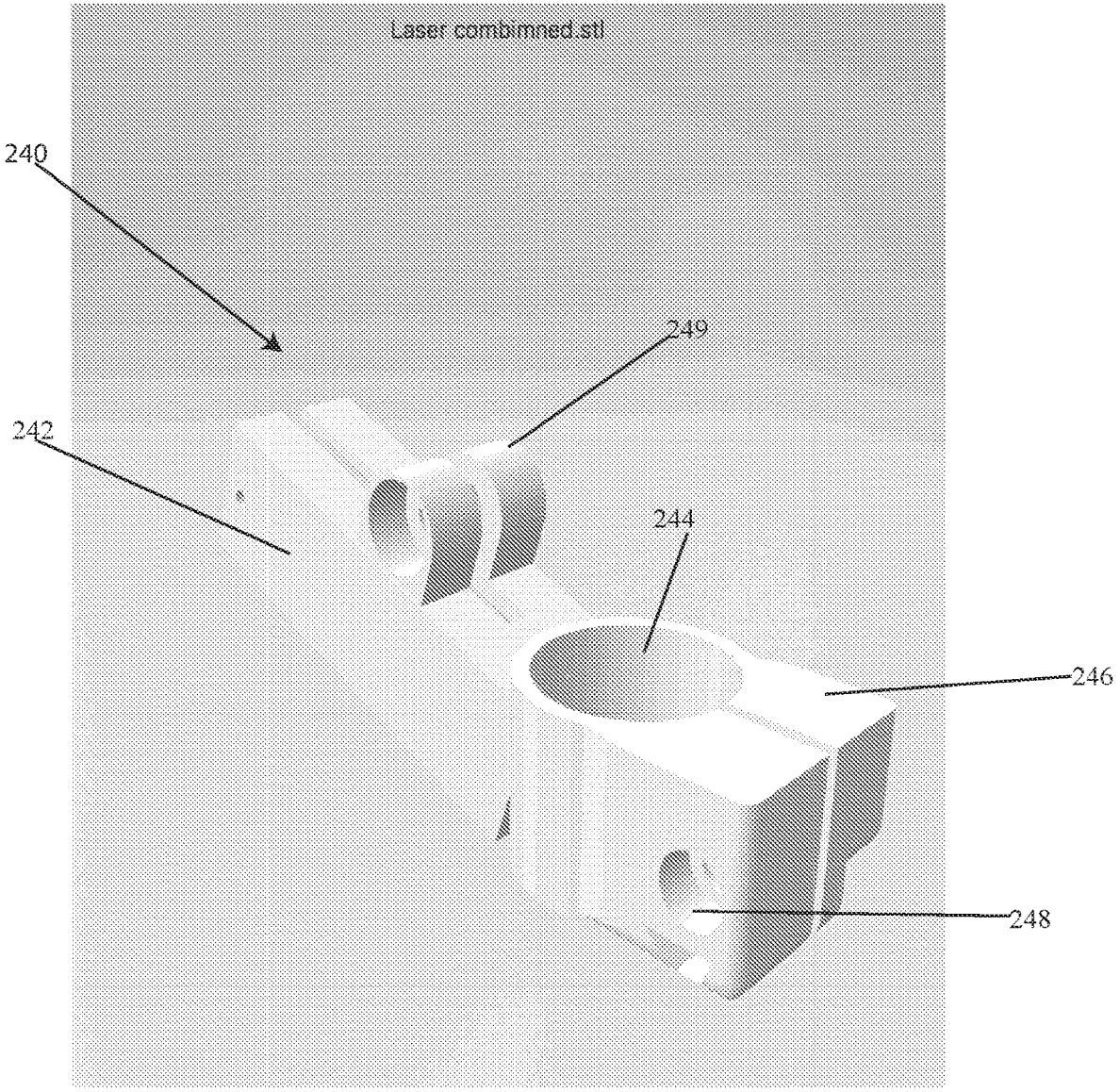
FIG. 11 is a perspective view of a laser combined bracket.
Figure 12:
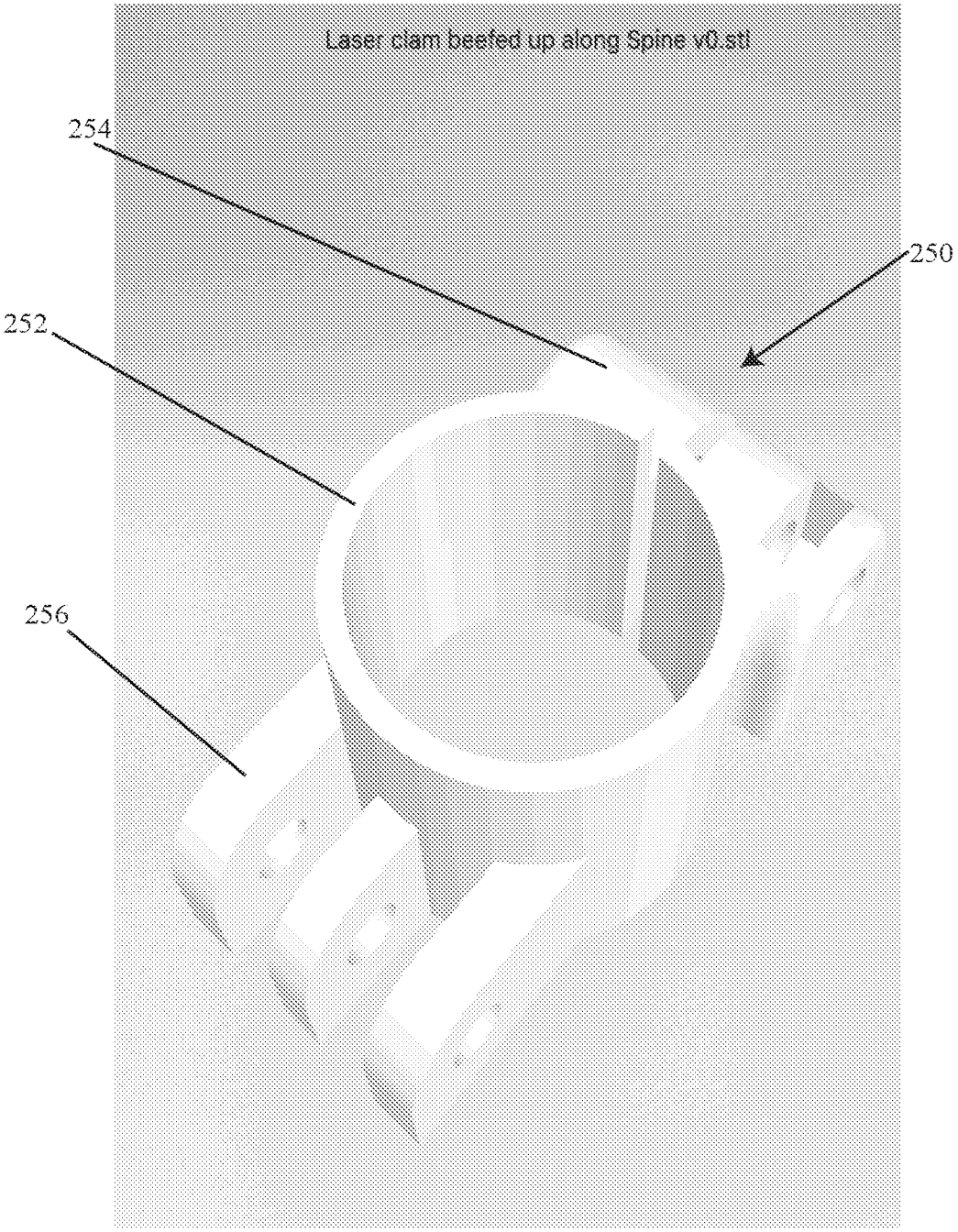
FIG. 12 is a perspective view of a laser clamshell beefed up along the spine.

FIG. 11 is a perspective view of a laser combined bracket 240 which can be coupled to the frame and which includes a body section 242, a loop section 249 allowing the laser to be rotated about a shaft disposed inside of the loop section. There is also an opening 244 in a block section 246 wherein block section 246 includes a lock opening 248 for receiving a lock to clamp the block 246 around a laser housed inside of opening 244. The following are the components shown in FIG. 11: 240: Fixed angle alignment laser beam holster; 242: Side of laser holster with 3 hole(s) for fine-tuning screws used to calibrate direction of laser; 244: Slides onto spine for repositioning fore/aft. 246: Spine mounting clamp; 248: Spine clamp inset screw; 249: Tightening screw/nut to clamp onto laser device FIG. 12 is a perspective view of a laser spine sliding mount 250 disposed along the spine such as spine 58. This laser spine mount includes a locking body section 254, an opposite lock 256 to attach an adjustable-angle laser holster as well as a central column 252 for tightening the mount to the spine. The following are components shown in FIG. 12: 250: Adjustable sliding spine mount; 252: Slides onto spine for repositioning fore/aft; 254: Locking body section; 256: Locking adjustable angle device attachment.

Figure 13:
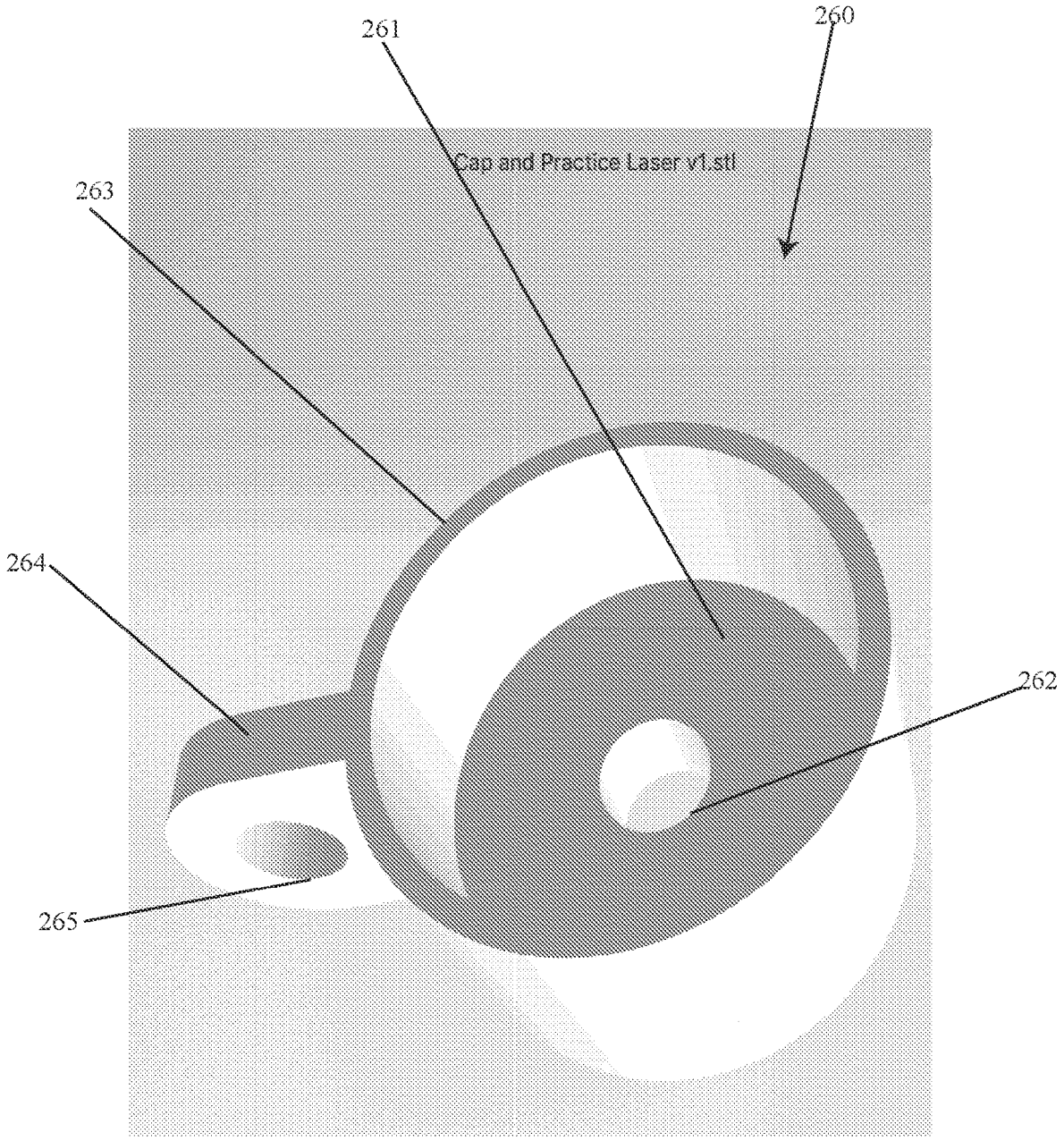
FIG. 13 is a perspective view of the cap and practice laser.
Figure 14:
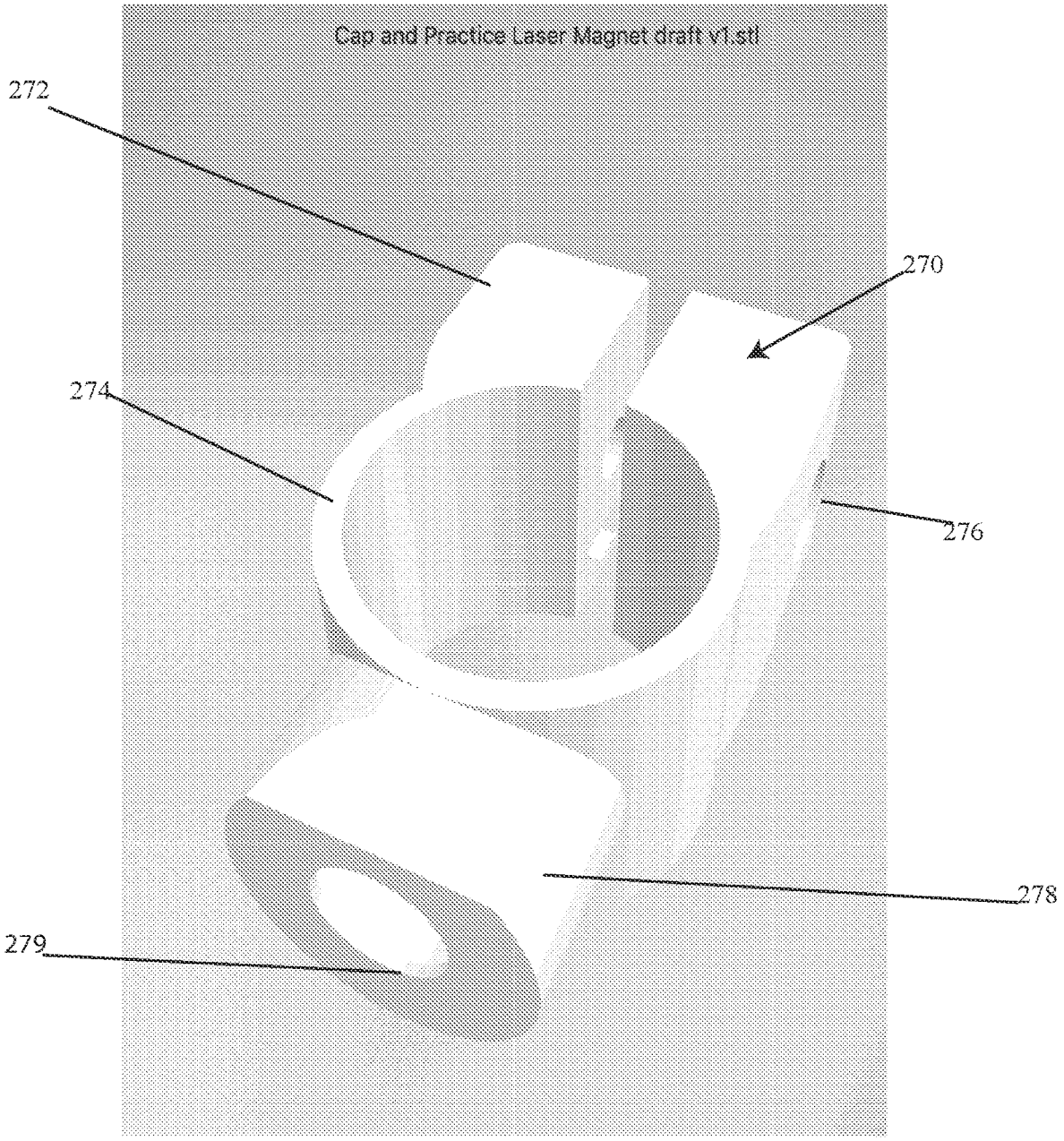
FIG. 14 is a perspective view of the cap and practice laser magnet.

FIG. 13 is a perspective view of the rotatable practice laser device mounting portion 260 which can be couple to the frame or spine such as frame 20 or 50 or spine 58 and which is designed to attach to the practice laser spine clamp 270 from FIG. 14. This practice laser connector 260 has a cavity 261 designed to carry donut-shaped magnets, a cylindrical section 263 that fits snuggly but rotates freely around 278 (from FIG. 14), a device mount tab 264, and a hole 262 for a screw to hold magnets into place. The following are components shown in FIG. 13: 260. Rotatable magnetic practice laser attachment device; 261: Cavity to hold donut shaped magnets; 262: Screw to hold magnets into place; 263: Wall to fit cap over cylinder protrusion 278 (from FIG. 14); 264: Tab to mount laser holster device; 265: Hole to adjust and hold laser mount holster at set angle.

FIG. 14 is a perspective view of the spine clamp portion 270 of the rotatable practice laser device mount. This device includes a body 272 having an opening 274 for mounting onto the spine. There is a locking hole 276 for receiving a screw to tighten the clamp 274 around the spine. The cylindrical protrusion of the device 278 carries steel washers that attract to the magnets contained in 261 (FIG. 13), thus holding the laser mount in place while allowing cylindrical section 263 to rotate freely round it. There is also an opening 279 to accommodate the magnet mounting screws from 260. The following are components listed in FIG. 14: 270: Spine clamp for rotatable practice laser attachment device; 272: Locking block with nut; 276: Locking screw; 274: Opening for spine; 278: Cylindrical protrusion with steel washers inside; 279: Opening to accommodate screws that hold 262 magnets into place. The components of FIGS. 7-14 can be used with the racks 20 and 50 shown above.

Thus, there is created a design for a lighting system for a billiard table which is configured to allow a user to adjust and align the lighting system over a billiard table to provide substantially symmetrical light by using laser guides such as a laser line or a laser dot.

Accordingly, while at least one embodiment of the present invention have been shown and described, it is to be understood that many changes and modifications may be made thereunto without departing from the spirit and scope of the invention as defined in the appended claims.

What is claimed is:

1. A lighting system for a billiard table comprising:

a frame disposed above the billiard table and extending around a periphery of the billiard table;

a plurality of lights disposed in the frame;

at least one lens coupled to the frame, said at least one lens for focusing a light produced by at least one light disposed in the frame;

at least one arm coupled to the frame said at least one arm extending inward over the billiard table;

at least one additional light coupled to said at least one arm, said at least one additional light comprising a light emitter pointed down towards the billiard table for shining a light over a central region of the billiard table.

2. The lighting system as in claim 1, wherein said plurality of lights comprise at least one LED light.

3. The lighting system as in claim 1, wherein said frame is a substantially rectangular frame.

4. The lighting system as in claim 3, wherein said frame comprises at least two longitudinally extending sections which are spaced substantially parallel to each other and at least two latitudinally extending sections extending substantially transverse to the longitudinally extending sections wherein said latitudinally extending sections are coupled to the longitudinally extending sections.

5. The lighting system as in claim 4, further comprising a center beam extending across a center region of the frame between at least one of the at least two longitudinally extending sections.

6. The lighting system as in claim 5 further comprising at least one rib extending transverse to the center beam.

7. The lighting system as in claim 1, wherein said at least one additional light is a laser light.

8. The lighting system as in claim 7, wherein said at least one additional light is a laser light configured to produce a laser line.

9. The lighting system as in claim 7, wherein said at least one additional light is a laser light configured to produce a dot.

10. The lighting system as in claim 1, further comprising at least one sliding bracket coupled to said at least one arm.

11. The lighting system as in claim 10, wherein said at least one sliding bracket comprises a sliding mount comprising at least one lock.

12. The lighting system as in claim 11, wherein said at least one sliding bracket comprises at least two sliding brackets, wherein a first sliding bracket allows said at least one additional light to slide along a first axis and said at least two sliding brackets comprises a second sliding bracket allowing said at least one additional light to slide along a second axis.

13. The lighting system as in claim 1, further comprising at least one rotatable mount, said at least one rotatable mount coupled to said at least one arm, said at least one rotatable mount for rotatably mounting said at least one additional light.

14. The lighting system as in claim 13, further comprising at least one additional rotatable mount, said at least one additional rotatable mount for allowing said at least one additional light to rotate along at least two different axes.

15. The lighting system as in claim 1, wherein said at least one arm comprises a telescoping arm.

16. The lighting system as in claim 1, wherein said at least one arm comprises at least one cylindrical arm.

17. The lighting system as in claim 1, wherein said at least one additional light comprises at least two laser lights.

18. The lighting system as in claim 17, wherein said at least two laser lights comprises a first laser light for lighting a first section of a table, and a second laser light for lighting a second section of a table.

19. The lighting system as in claim 18, wherein said first laser light provides a laser dot beam and said second laser light provides a linear beam.

* * * * *